US005988897A

United States Patent [19]

Pierce et al.

[11] Patent Number: 5,988,897

[45] Date of Patent: Nov. 23, 1999

[54] METHOD FOR PREVENTING FRAUDULENT PRINTING OF A POSTAGE INDICIUM DISPLAYED ON A PERSONAL COMPUTER

[75] Inventors: Perry A. Pierce, Darien; Brian M. Romansky, Monroe, both of Conn.

[73] Assignee: Pitney Bowes Inc., Stamford, Conn.

[21] Appl. No.: 08/922,875

[22] Filed: Sep. 3, 1997

[51] Int. Cl.[6] ..... B41J 5/30

[52] U.S. Cl. ..... 400/61; 400/103

[58] Field of Search ..... 40/61, 103, 70, 40/104, 76; 364/464.02, 464.03; 395/101, 109, 117

[56] References Cited

U.S. PATENT DOCUMENTS

| | | | |
|---|---|---|---|
| 5,240,334 | 8/1993 | Epstein et al. | 400/88 |
| 5,243,175 | 9/1993 | Kato | 235/435 |
| 5,251,289 | 10/1993 | Fidler et al. | 395/112 |
| 5,257,197 | 10/1993 | Gunther et al. | 364/464.02 |
| 5,319,532 | 6/1994 | Whitehouse | 364/464.03 |
| 5,369,258 | 11/1994 | Sansone et al. | 235/381 |
| 5,700,037 | 12/1997 | Keller | 283/107 |
| 5,745,260 | 4/1998 | Blazey | 358/456 |
| 5,835,689 | 11/1998 | Braun et al. | 395/113 |
| 5,870,473 | 2/1999 | Boesch et al. | 380/21 |

*Primary Examiner*—John Hilten

*Attorney, Agent, or Firm*—Charles R. Malandra, Jr.; Melvin J. Scolnick

[57] ABSTRACT

A method for printing an IBIP indicium in an IBIP open metering system includes the steps of obtaining a bit mapped image of a fixed graphic portion of the indicium and drawing a bit mapped image of a variable portion of the indicium using indicium data elements. Then it is determined whether the indicium is to be printed of displayed. If displayed, a bit mapped image of a representative bar code is generated; and a message that indicates the barcode is not valid for printing is applied to the bit mapped image of the representative bar code. The bit mapped image of the indicium can safely be displayed. Whenever an IBIP indicium is being displayed, the whole indicium is shown on the screen with a message, such as "NOT VALID FOR MAILING" superimposed over the PDF bar code area. This gives the user means to visually design the mailpiece with an IBIP indicia in its to-be-printed form but with a distinguishing characteristic that makes it impossible for a postal worker to mistake it for a valid IBIP indicium should it be copied by standard user interface functions and printed.

4 Claims, 3 Drawing Sheets

METHOD FOR PREVENTING FRAUDULENT PRINTING OF A POSTAGE INDICIUM DISPLAYED ON A PERSONAL COMPUTER

FIELD OF THE INVENTION

The present invention relates generally to a method for printing a postage indicium and, more particularly, to such method for printing a postage indicium using a personal computer.

RELATED APPLICATIONS

The present application is related to the following U.S. patent applications Ser. Nos. 08/575,106 (which issued as U.S. Pat. No. 5,625,694), 08/575,107 (which issued as U.S. Pat. No. 5,781,438), 08/574,746 (which issued as U.S. Pat. No. 5,835,604), 08/574,745 (which issued as U.S. Pat. No. 5,742,683), 08/575,110, 08/574,743 (which issued as U.S. Pat. No. 5,793,867), 08/575,112, 08/575,109, 08/575,104 (which issued as U.S. Pat. No. 5,835,689), and 08/574,749 (which issued as U.S. Pat. No. 5,590,198), all filed Dec. 18, 1995, and assigned to the assignee of the present invention., and U.S. patent application Ser. No. 08/922,874 filed concurrently herewith.

BACKGROUND OF THE INVENTION

The Information-Based Indicia Program (IBIP) is a distributed trusted system proposed by the United States Postal Service (USPS) to retrofit and augment existing postage meters using new technology known as information-based indicia. The program relies on digital signature techniques to produce for each envelope an indicium whose origin cannot be repudiated. IBIP is expected to support new methods of applying postage in addition to, and eventually in lieu of, the current approach, which typically relies on a postage meter to mechanically print indicia on mailpieces. IBIP requires printing a large, high density, two-dimensional (2-D) bar code on a mailpiece. The 2-D bar code encodes information and is signed with a digital signature.

The USPS has published draft specifications for IBIP. The INFORMATION BASED INDICIA PROGRAM (IBIP) INDICIUM SPECIFICATION, dated Jun. 13, 1996, ("IBIP Indicium Specification") defines the proposed requirements for a new indicium that will be applied to mail being processed using IBIP. The INFORMATION BASED INDICIA PROGRAM POSTAL SECURITY DEVICE SPECIFICATION, dated Jun. 13, 1996, ("IBIP PSD Specification") defines the proposed requirements for a Postal Security Device (PSD) that will provide security services to support the creation of a new "information based" postage postmark or indicium that will be applied to mail being processed using IBIP. The INFORMATION BASED INDICIA PROGRAM HOST SYSTEM SPECIFICATION, dated Oct. 9, 1996, defines the proposed requirements for a host system element of IBIP ("IBIP Host Specification"). The specifications are collectively referred to herein as the "IBIP Specifications". IBIP includes interfacing user (customer), postal and vendor infrastructures which are the system elements of the program.

The user infrastructure, which resides at the user's site, comprises a postage security device (PSD) coupled to a host system. The PSD is a secure processor-based accounting device that dispenses and accounts for postal value stored therein. The host system (Host) may be a personal computer (PC) or a meter-based host processor.

The IBIP Indicium Specification provides requirements for the indicium that consists of both human-readable data and PDF417 bar code data. The human-readable information includes an originating address, including the 5-digit ZIP Code of the licensing post office, PSD ID/Type number, date of mailing and amount of the applied postage. The bar code region of the indicium elements includes postage amount, PSD ID, customer ID, date of mailing, originating address, destination delivery point identification, ascending and descending registers and a digital signature.

An integrated mailing system is subject to open system requirements if it includes a computer interfaced to the meter and it prepares mailpiece fonts or labels that include both the destination address and the indicium. The integrated system is an open system even if different printers apply the address and the indicium. If the mailing system satisfies such criteria, the USPS considers the "meter" to be an open system peripheral device that performs the dual functions of printing the indicia and interfacing the PSD to the open host. The integrated mailing system must be approved by the USPS according to open system criteria.

The IBIP Host Specification sets forth the requirements for a Host in an open system. The Host produces the mailpiece front including the return address (optional), the delivery address (required), the Facing Identification Mark (FIM), and the indicium as an integral unit. The Host may print this unit on the actual mailpiece stock or label(s) for later attachment to the mailpiece. The Host provides the user with an option to omit the FIM (e.g., when the FIM is preprinted on envelopes). The Host produces standardized addresses, including standard POSTNET delivery point bar code, for use on the mailpiece. The Host verifies each address at the time of mailpiece creation. The Host then creates the indicium and transmits it to the printer.

It is expected that once IBIP is launched, the volume of meters will increase significantly when the PC-based meters are introduced. Such volume increase is expected in the small office and home office (SOHO) market. The IBIP Specifications address and resolve issues which minimize if not eliminate USPS risks regarding security and fraud. However, as with any system implemented on a non-secure device, such as a personal computer, an implementation of an IBIP system may have inherent security weaknesses that could be exploited by sophisticated users intent on defrauding the USPS.

For example, a typical user interface for application programs provides a user with the ability to display a "print preview" of a document prior to printing the document. The IBIP Specifications does not preclude the Host from similarly displaying completely prepared mailpieces, i.e. envelopes with destination address, return address and indicium, prior to printing the envelope. Such display of the mailpiece may subject to abuse by a user.

SUMMARY OF THE INVENTION

In an open metering system, an IBIP host may include a feature that displays an envelope created for a particular mailpiece, which includes an IBIP indicium generated for the mailpiece. In particular, using the WSYWIG (What you see is what you get) presentation available, for example in Windows™ environments today, such display of the indicium provides an opportunity for printing multiple copies of an indicium which otherwise would not be allowed by the Host software controlling the creation and printing of the mailpiece. A simple print screen function, such as in the operating system, could be used to print an unauthorized copy of the indicium. It has been found that the present invention prevents a user from copying the screen to get an IBIP indicium that would pass through standard USPS IBIP inspection points should the program display what appears to be a valid indicium and the USPS does not scan 100% of all Indicia printed by the IBIP metering system.

The present invention provides a method for printing an IBIP indicium in an IBIP open metering system includes the steps of obtaining a bit mapped image of a fixed graphic portion of the indicium and drawing a bit mapped image of a variable portion of the indicium using indicium data elements. Then it is determined whether the indicium is to be printed or displayed. If displayed, a bit mapped image of a representative bar code is generated; and a message that indicates the barcode is not valid for printing is applied to the bit mapped image of the representative bar code. The bit mapped image of the indicium can safely be displayed.

In accordance with the present invention, whenever the IBIP indicium is being displayed, the whole indicium is shown on the screen with a message, such as "NOT VALID FOR MAILING" superimposed over the PDF bar code area. This gives the user means to visually design the mailpiece with an IBIP indicia in its to-be-printed form but with a distinguishing characteristic that makes it impossible for a postal worker to mistake it for a valid IBIP indicium. The superimposed text also renders the bar code unreadable by automated equipment.

DESCRIPTION OF THE DRAWINGS

The above and other objects and advantages of the present invention will be apparent upon consideration of the following detailed description, taken in conjunction with accompanying drawings, in which like reference characters refer to like parts throughout, and in which.

DETAILED DESCRIPTION OF THE PRESENT INVENTION

Figure 1:
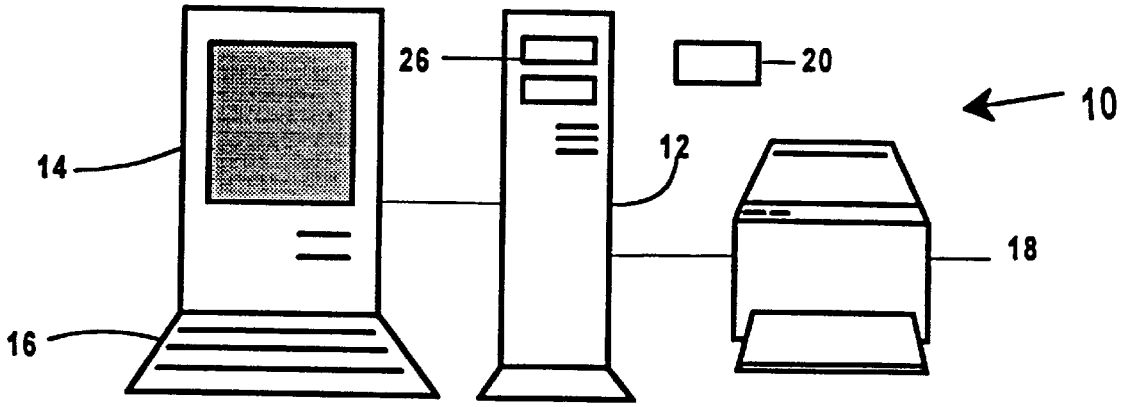
FIG. 1 is a block diagram of a prior art open system in accordance with IBIP.

In describing the present invention, reference is made to the drawings, wherein there is seen in FIG. 1 an IBIP open metering system, also referred to herein as a PC meter system, generally referred to as 10, comprising a conventional personal computer (PC) 12 configured to operate as a host to a peripheral metering device, referred to by the IBIP as a PSD, generally referred to as 20, in which postage funds are stored. IBIP open metering system 10 uses PC 12 and its printer to print postage on envelopes at the same time it prints a recipient's address or to print labels for pre-addressed return envelopes or large mailpieces. It will be understood that although the preferred embodiment of the present invention is described as a postage metering system, the present invention is applicable to any value metering system that includes transaction evidencing using an unsecured printer.

The IBIP open metering system 10 includes a Host PC 12, a display 14, a keyboard 16, and an unsecured digital printer 18, which is preferably a laser or ink-jet printer. PC 12 includes a conventional processor, such as the Pentium processors manufactured by Intel, and conventional hard drive, floppy drive(s) 26, and memory. PSD 20 is a microprocessor-based secure encryption device for postage funds management, signature of postal data and traditional accounting functions. PC meter system 10 may also include an optional modem (not shown) by which the Host can communicate with a Postal Service or a postal authenticating vendor for recharging funds (debit or credit). In an alternate embodiment the modem may be located in PSD 20. In yet another alternate embodiment, the metering functions performed by the PSD may be performed by a software based accounting module located at a Data Center. See, for example, U.S. Pat. No. 5,454,038.

Figure 2:
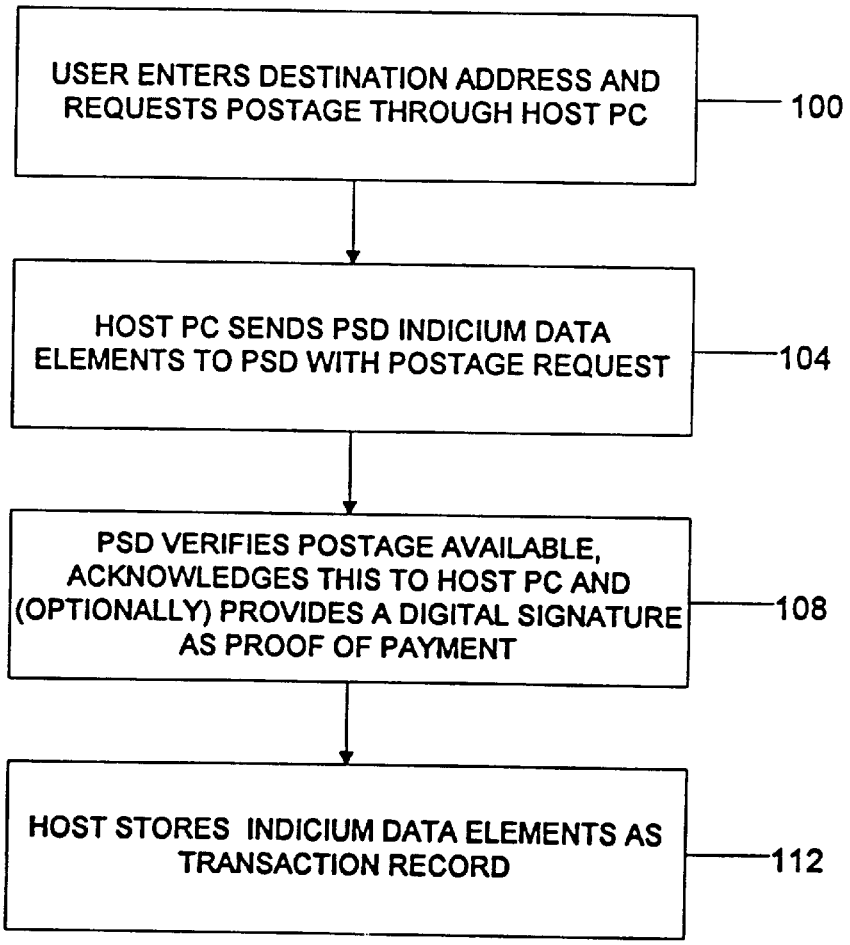
FIG. 2 is a flow chart of creation of an indicium for a mailpiece.

Referring now to FIG. 2, there is seen a method for generating an IBIP indicium. At step 100, the user enters a destination address and request postage therefor. At step 104, the Host sends to the PSD indicium data elements to the PSD with a request for postage. At step 108, the PSD verifies the requested postage is available, signs the indicium data elements, debits the postage account and sends the signed indicium data elements to the Host. At this point the Host is ready to generate the indicium bit map for printing.

It will be understood that a conventional print preview of an envelope with a complete IBIP indicium including bar code would present an opportunity for misuse of the IBIP indicium. Specifically, selecting a print screen function while the print preview is on the screen would provide a user with the capability to print additional copies of a valid indicium that would pass human review. Only complete IBIP verification could detect such misuse. The present invention provides for the safe display of an IBIP indicium on a computer screen so that if a user was to copy the screen using, for example, standard print screen commands, the meter indicium could not be mistaken for a valid indicium.

When displaying a preview of a mailpiece, it is desirable that the representation of the indicium contains the same human readable data that will be used in the actual mailpiece. This can not be achieved if the entire indicium representation is drawn on screen using a fixed image of a single indicium. It must be a dynamic object that is updated for every preview.

An important feature of the PDF417 bar code generation process is that the size of the bar code will vary depending on the type of output device that it will be printed on. It is desirable to represent the actual size of the bar code in an "on screen" preview of the indicium. This can not be achieved if the bar code portion of the indicium is created from a fixed graphic image.

The desired results may be achieved by using the same software module to create the on-screen indicium and the printed indicium. In accordance with the present invention, two measures are used to ensure that the on-screen indicium can not be used for creating fraudulent postage. First the bar code data does not contain valid postage information such that it would fail postal inspection. Second, a label containing text "Not Valid for Mailing" or some similar message is superimposed over the bar code graphics such that the resulting image is obviously different from a valid mailpiece.

Figure 3:
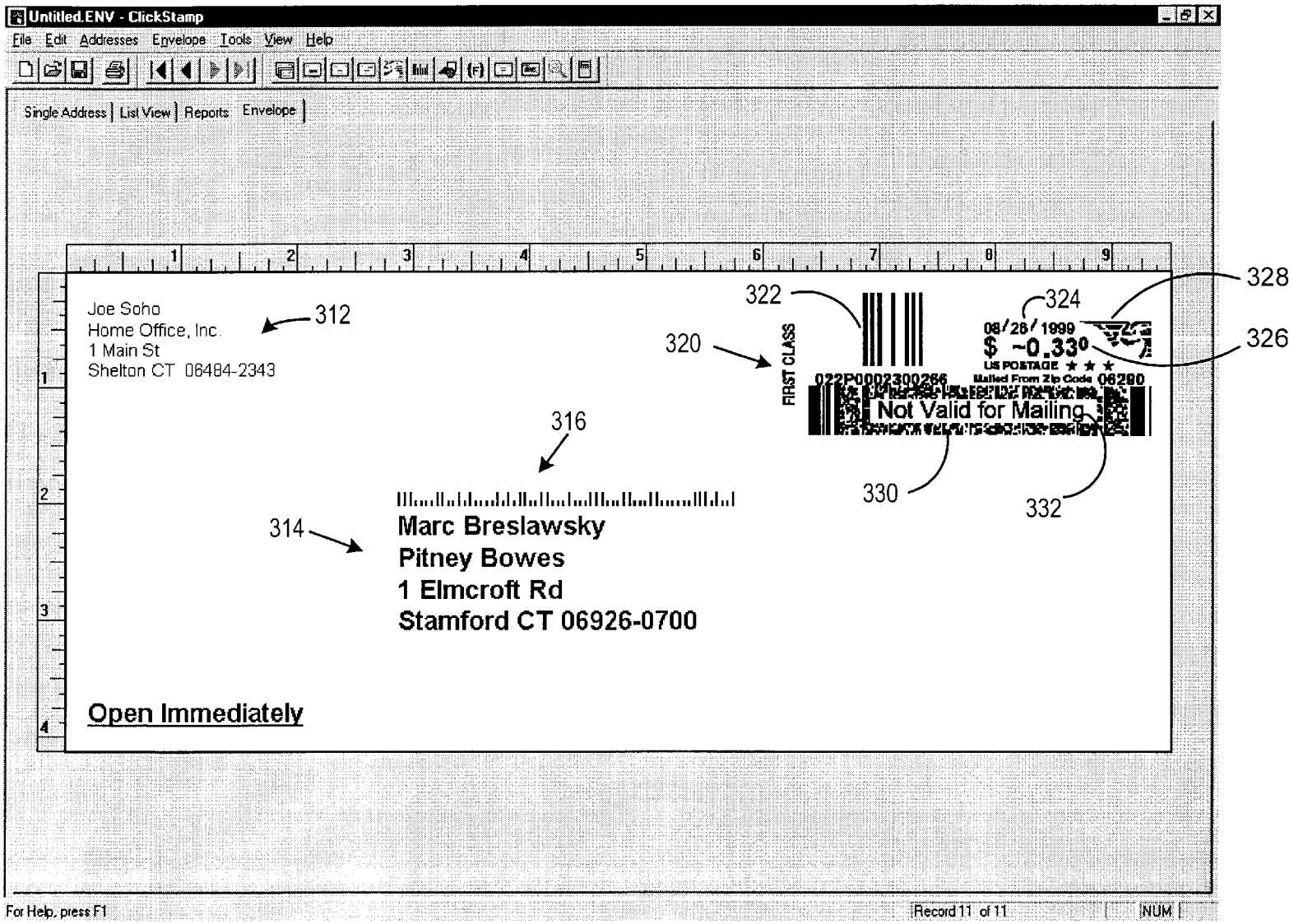
FIG. 3 is a print preview display of the mailpiece created in accordance with the present invention.

Referring now to FIG. 3, the "print preview" display 300 of an envelope 310 is shown. Envelope 310 includes a return address 312, destination address 314, including POSTNET bar code 316, and IBIP indicium 320. The IBIP indicium 320 includes FIM 322, date 324, postage amount 326, fixed graphics 328 and PDF417 bar code 330 with a message "NOT VALID FOR MAILING" 332 superimposed thereon.

Figure 4:
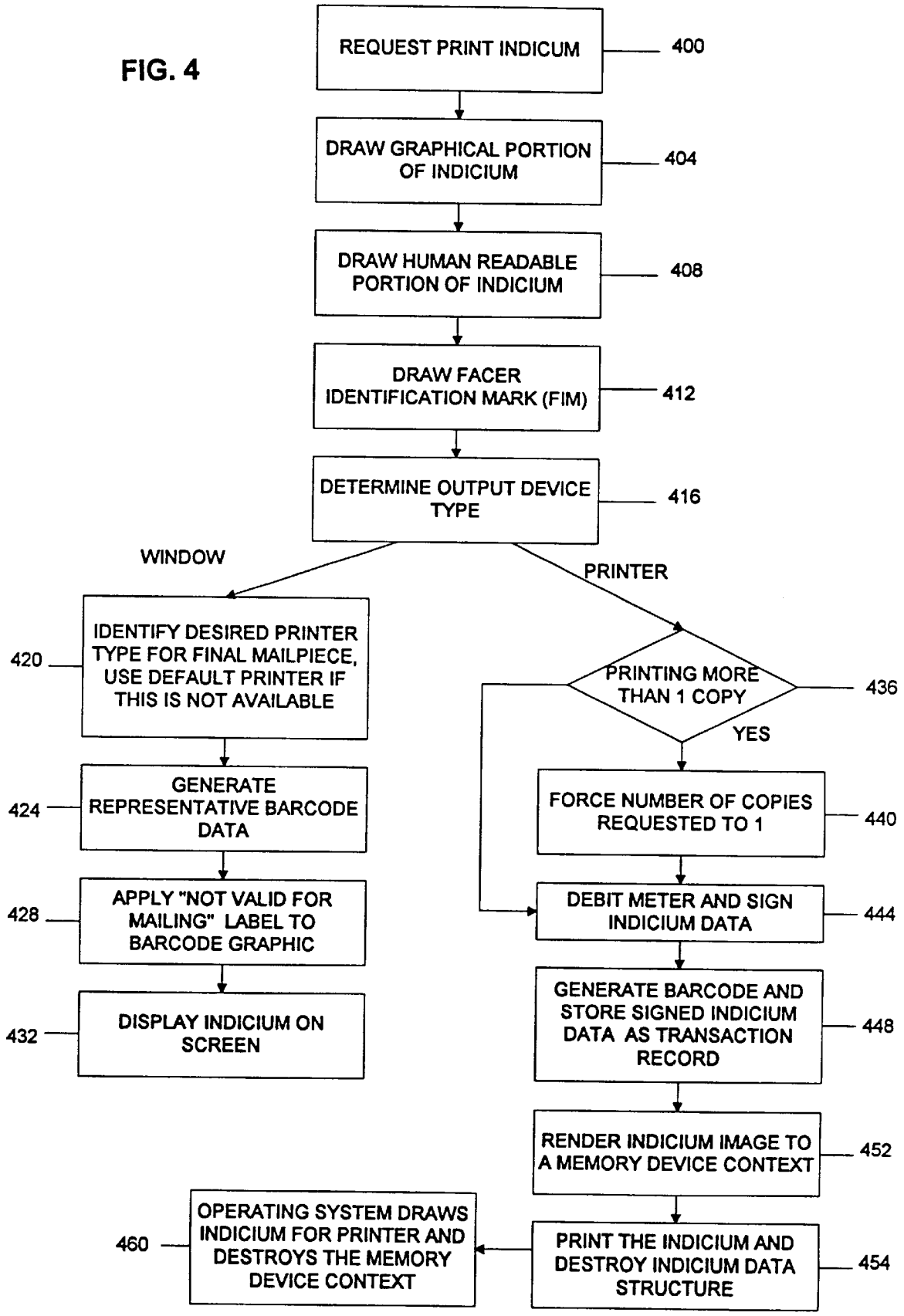
FIG. 4 is a flow chart of the creation and display of the mailpiece of FIG. 3.

Referring now to FIG. 4, the method of displaying the indicium before printing is shown. As used herein the term "drawn" means the bit mapped image is created. At step 400, a request to print the indicium is initiated by the user. At step 404, the fixed graphics portion, for example an eagle, of the indicium is drawn. It will be understood by those skilled in the art that the fixed graphics portion may be drawn once and stored for repeated use. At step 408, the variable, i.e. human readable, portion of the indicium is drawn. At step 412, the FIM is drawn. Before the PDF417 bar code is drawn it is determined, at step 416, if the indicium will be output to the display or to the printer. If to the display, then at step 420, the desired printer type that will be used to print the mailpiece is identified. A default printer of the Host can be used automatically unless another printer is selected. For this step, Identifying the type of printer that will be used to print the mailpiece is important from a WYSWYG view. It has been found that the desired bar code module size for IBIP indicia is optimally determined based on the quality of the paper on which it is printed and the type of printer used to print the indicia. See U.S. patent application Ser. No. 08/771,992, now U.S. Pat. No. 5,871,288, entitled METHOD FOR CUSTOMER SELECTABLE MODULE SIZE FOR AN INFORMATION BASED INDICIA, filed Dec. 23,1996 and assigned to the assignee of the present invention.

At step 424, the Host generates a representative bar code. Preferably, the representative bar code is generated and drawn from sample indicium data that would fail a verification scan but which has the dimensions and appearance of an IBIP barcode. However, it is noted that the representative bar code can be generated from the actual indicium data because of the following step. At step 428, a message, such as "Not Valid for Mailing" is applied to the bar code bit map so as to overlay, i.e., replace, a section of the representative bar code previously generated. Finally, at step 432, the drawn indicium, including bar code graphic with overlay, is displayed as a print preview screen of the Host.

If at step 116 the indicium is to be output to the printer, then at step 436 a check is made to determine if the operating system of the Host PC has been configured to print more than one copy of the indicium. If more than one copy is to be printed, then at step 440, the application software in the Host PC will force the operating system to print only one copy of the indicium. Then at step 444, or if the operating system was printing only one copy at step 436, the Host PC sends a message to the PSD that the indicium is about to be printed and the PSD debits the available postage amount for the postage value of the indicium. At step 448, the application software generates the PDF417 barcode and stores the signed indicium data as a transaction record on the hard drive. At step 452, the application software renders the indicium image to a memory device context. At step 454, the application software destroys the indicium data structure, i.e. the bit mapped image of the indicium, that has been drawn in the memory of the Host PC. Finally at step 460 and the operating system of the PC draws the indicium for the printer to print and destroys the memory device context. It will be understood that the destruction of the indicium data structure and the memory device context can be achieved by writing over the memory containing them with unrelated information or by zeroing the contents of the memory.

Thus, the present invention provides a user interface method that permits a print preview of the envelope to be printed without compromising the security of the IBIP verification process.

While the present invention has been disclosed and described with reference to a single embodiment thereof, it will be apparent, as noted above, that variations and modifications may be made therein. It is, thus, intended in the following claims to cover each variation and modification that falls within the true spirit and scope of the present invention.

What is claimed is:

1. A method for displaying an information-based indicia program (IBIP) indicium before printing the indicium on a mailpiece, the method comprising the steps of:

obtaining a bit mapped image of a fixed graphic portion of the indicium;

drawing a bit mapped image of a variable portion of the indicium using indicium data elements;

generating a bit mapped image of a representative bar code;

applying to the bit mapped image of the representative bar code, a message indicating the bar code is not valid for mailing; and displaying a bitmapped image of the indicium, said indicium bitmapped image including said bit mapped images of the fixed graphics portion, the variable portion and the representative bar code.

2. The method of claim 1, comprising the further steps of:

determining type of printer to be used in printing the indicium; and scaling the size of the bit mapped image of the bar code according to the type of printer.

3. A method for printing an information-based indicia program (IBIP) indicium in an IBIP open metering system, the method comprising the steps of:

obtaining a bit mapped image of a fixed graphic portion of the indicium;

drawing a bit mapped image of a variable portion of the indicium using indicium data elements;

determining whether the indicium is to be printed or displayed;

generating a bit mapped image of a representative bar code when the indicium is to be displayed;

applying to the bit mapped image of the representative bar code, a message indicating barcode is not valid for mailing; and displaying a bitmapped image of the indicium, said indicium bitmapped image including said bit mapped images of the fixed graphics portion, the variable portion and the representative bar code.

4. The method of claim 3, comprising the further steps of generating a bit mapped image of a bar code using indicium data elements when the indicium is to be printed;

printing a bitmapped image of the indicium, said indicium bitmapped image including said bit mapped images of the fixed graphics portion, the variable portion and the bar code.

* * * * *